US005129650A

United States Patent [19]

Hayman

[11] Patent Number: 5,129,650

[45] Date of Patent: Jul. 14, 1992

[54] APPARATUS AND METHOD FOR PLAYING GOLF

[76] Inventor: Jesse M. Hayman, 29413 Ana Maria La., Laguna Niguel, Calif. 92677

[21] Appl. No.: 716,994

[22] Filed: Jun. 18, 1991

[51] Int. Cl.[5] ..... A63B 67/02; A63B 65/00

[52] U.S. Cl. ..... 273/77 A; 273/317; 124/5

[58] Field of Search ..... 273/77 R, 77 A, 77 B, 273/317, 318, 327, 412; 124/5

[56] References Cited

U.S. PATENT DOCUMENTS 2,705,148 3/1955 Waller ..... 273/317

2,902,023 9/1955 Waller ..... 273/58 B X

FOREIGN PATENT DOCUMENTS 470791 6/1914 France ..... 273/327

*Primary Examiner*—William H. Grieb

[57] ABSTRACT

A set of flexible throwing rods each have a handle on one end for grasping and a gradual narrowing taper toward the other end. Each throwing rod has a varying length ranging from approximately 15 inches to approximately four feet. One such rod is selected, depending upon the distance to a target, onto which a ball with a diametrical hole therethrough is slid. A whip-like action of the rod forces the ball off of the end, the speed of which is dependent upon the length of the rod.

8 Claims, 3 Drawing Sheets

APPARATUS AND METHOD FOR PLAYING GOLF

FIELD OF THE INVENTION

This invention relates to games and corresponding amusement devices. More particularly, this invention relates to a golf-like game involving the projection of a ball from a flexible throwing rod.

BACKGROUND OF THE INVENTION

Apparati for projecting a ball from a throwing rod are well known. Devices of this type generally employ a ball with a diametrical hole therethrough for slidably engaging a thin, flexible throwing rod. The throwing rod is usually characterized by a handle on one end for grasping and a gradual taper on the other end. In operation, a person slides a ball down the shaft of the throwing rod toward the handle. The ball is thrown by swinging the stick in a whip-like motion toward a target. Centrifugal force causes the ball to slide along the rod and off the end thereof. The speed at which the ball is projected is dependent upon the strength of the throw, the length and flexibility of the throwing rod, and the friction created by the ball sliding along the throwing rod.

Most of the known devices, such as that described in U.S. Pat. No. 2,902,023 issued to Waller on Mar. 29, 1955, utilize a hollow ball, as a solid ball has so much momentum after being projected that it causes great discomfort to a person attempting to catch it. While this may be a concern for some games, clearly not all games require a person on the receiving end of a throw. For example, it has been found that devices of this type are particularly well suited for use on a golf course, following generally the same rules as the game of golf. Because the speeds and distances that can be achieved from such devices are similar to those that can be achieve by striking a golf ball with a golf club, a golf ball with a diametrical hole therethrough can be used with such devices in an extremely entertaining fashion and with a high degree of accuracy.

Using such a device in this manner it was noticed that, as in the game of golf, at each successive throw the target is at a different distance from the ball. No provision is made in the devices of the currently known art for throwing rods with distinct distance ranges, as found in a set golf clubs with varying lengths. Clearly, such a game would be more enjoyable if specific distances could be achieved with consistency. The present invention fulfills these needs and provides further related advantages.

SUMMARY OF THE INVENTION

The present invention is a set of flexible throwing rods, each throwing rod having a handle on one end for grasping, and a gradual narrowing taper toward the other end to allow easy sliding of a golf ball, or the like, with a diametrical hole therethrough. Each throwing rod has a varying length ranging from approximately 15 inches for a rod with relatively small distance ranges, to a rod of approximately four feet for greater distance ranges. The longer throwing rods correspond to longer and more massive golf clubs, referred to as "woods." The shorter throwing rods correspond to shorter golf clubs with ball-striking faces relatively inclined, referred to as "irons" and "wedges."

In operation, the distance to a target, such as to a golf putting green, is estimated by the player. Based on this estimation, an appropriate throwing rod is selected. A ball is slid down the throwing rod until it reaches a point on the rod where the rod is approximately the same diameter as the hole in the ball. The ball is then slightly held in place on the rod by friction, thereby preventing the ball from inadvertently sliding off of the throwing rod during a practice swing, for example. The player, aiming at the target, swings the throwing rod in a whip-like manner with a generally overhead swing. Centrifugal force overcomes the friction holding the ball to the rod, thereby releasing the ball off of the end of the rod toward the target. This process is repeated until the ball has landed in close proximity to the target, for example, on the putting green. A conventional golf putter may then be used to hit the target directly.

One important feature of the present invention is that projecting a ball in this manner is easier to learn and generally easier to perform than hitting a golf ball with a conventional golf club. Lateral spinning of the ball upon release is almost non-existent with the present invention, thereby minimizing the lateral curving actions, known as "hook" or "slice," in conventional golf. As such, the present invention allows more people to enjoy a golf course and the entertainment and psychical challenge that such a course provides.

Use of the present invention does not, however, eliminate the challenge of trying to reach a target with a golf ball or the like. Consistently selecting the amount of pressure that holds the ball in place on the rod is a skill that must be learned. Moreover, the proper selection of the throwing rods and the force used when projecting a ball all require physical consistency to produce consistent results. As such, the present invention provides a similar, if slightly easier, challenge than does the standard game of golf. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
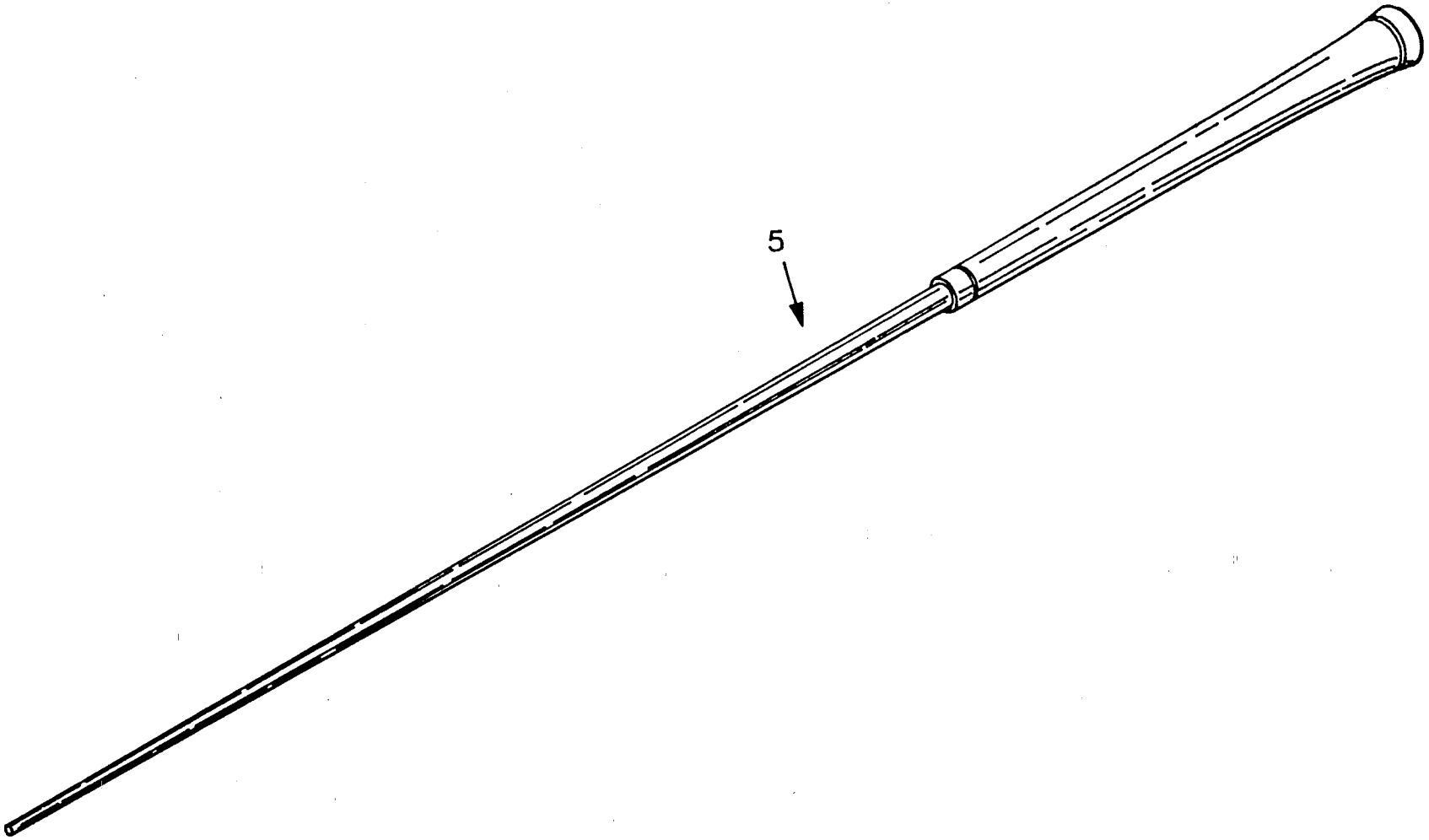
FIG. 1 is a perspective illustration of one of a set of flexible throwing rods of the invention.
Figure 2:
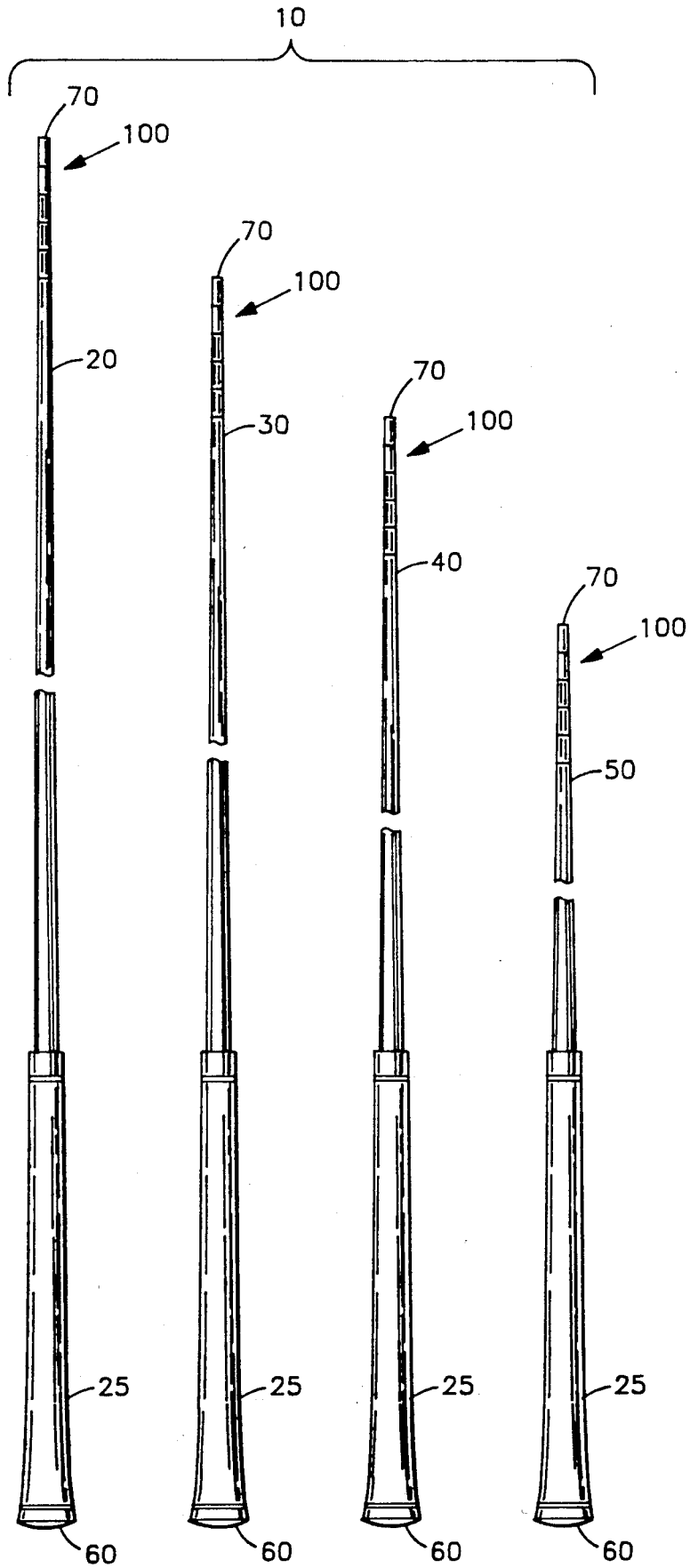
FIG. 2 is a top plan view of a set of flexible throwing rods of the invention, illustrating some of the possible relative lengths between each throwing rod.
Figure 3:
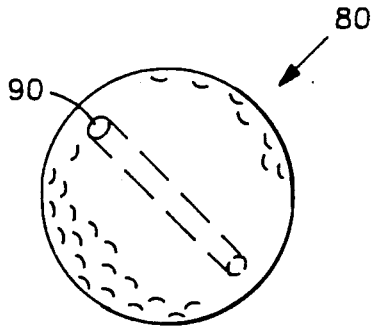
FIG. 3 is a perspective illustration of a ball of the invention, illustrating a diametrical hole therethrough.
Figure 4:
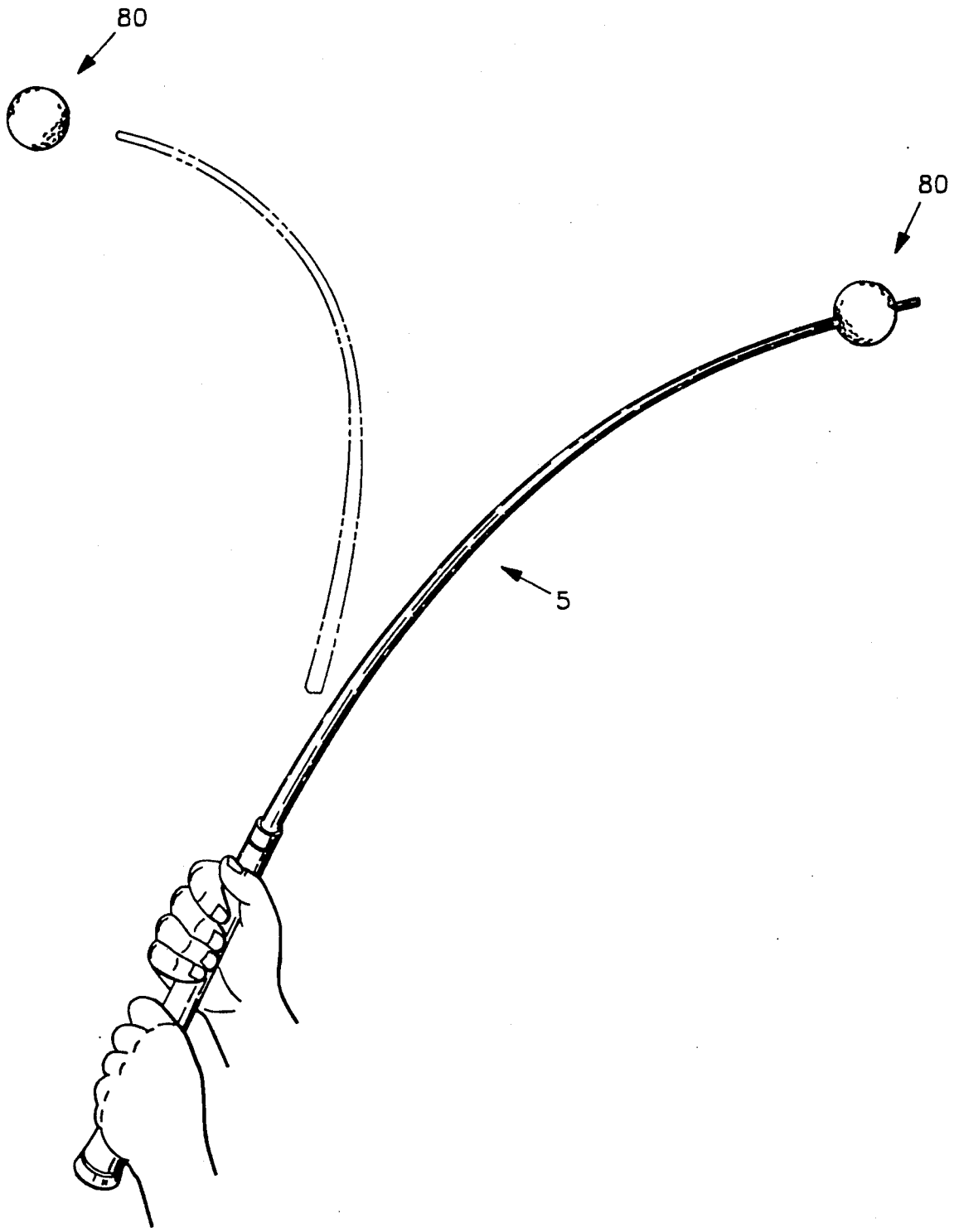
FIG. 4 is a perspective illustration of a person throwing the ball of the invention with one of the set of flexible throwing rods, illustrating a backswing position and a releasing position.

FIGS. 1 and 2 show a set 10 of flexible throwing rods 20, 30, 40, and 50. For simplicity of explanation in the following description, each rod 20, 30, 40, or 50 may be referred to as rod 5. Each rod 5 of the set 10 has a different flexibility, preferably between 0.1 and 0.25 inches per inch of rod length per pound of side deflection force, resulting in a different throwing power. Each rod 5 of the set 10 may also have a different length, preferably between 26 and 64 inches. In addition, each rod 5 has a first end 60 and a second end 70, a round cross-section, and a taper. The first end 60 has a larger diameter that the second end 70, and includes a grip 25 for grasping. Preferably, each rod 5 is made of a strong yet flexible material, such as graphite, graphite compound, fiberglass, or the like.

A round ball 80 has a diameter of a standard golf ball (not shown), and a diametrical hole 90 therethrough. The diameter of the hole 90 is such that with the second end 70 of the rod 5 inserted into the hole 90, the second end 70 of the rod 5 protrudes minimally beyond the ball 80 when the ball 80 is wedged thereon. Preferably, each rod 5 has graduations 100 (FIG. 2) to indicate the position of the ball 80 on the rod 5.

The invention is used to play a golf game where, in operation, an appropriate rod 5 from the set 10 is selected in accordance with the throwing power derivable therefrom to advance the ball from a starting point to a finish point such as a cup located on a putting green. The ball 80 is wedged onto the second end 70 of the chosen rod 5, using the graduations 100 as a positioning point for the ball 80 on the rod 5 to control the wedge force of the ball 80 on the rod 5. The rod 5 is then swung in an arc to dislodge the ball 80 from the rod 5 to project the ball 80 into space in a selected direction. This process is repeated in sequence as frequently as required to move the ball 80 incrementally from the starting point to the finish point.

While the invention has been described with reference to a preferred embodiment, it is to be clearly understood by those skilled in the art that the invention is not limited thereto. For example, any number of rods 5 may comprise a set 10 of such rods 5. Thus, the scope of the invention is to be interpreted only in conjunction with the appended claims.

What is claimed is:

1. Apparatus for playing golf on a golf course, comprising:

a set of flexible throwing rods, each rod of the set having a different flexibility resulting in a different throwing power, each of the rods having a first, and a second ends, a round cross-section, and a taper, the first end having a larger diameter than the second end;

a round ball having a diameter of a standard golf ball, and a diametrical hole therethrough such that with the second end of the rod inserted into the hole, the second end of the rod protrudes minimally beyond the ball when the ball is wedged thereon;

whereby an appropriate rod from the set of rods is selected in accordance with the throwing power derivable therefrom, the ball is wedged onto the second end of the rod, the rod is swung in an arc to dislodge the ball from the rod to project the ball into space in a selected direction, the process being repeated in sequence as frequently as required to move the ball incrementally from the tee to the green.

2. The apparatus of claim 1 wherein the overall length of the rods of the set of rods lies between approximately 26 and 64 inches.

3. The apparatus of claim 1 wherein the rods are made of graphite.

4. The apparatus of claim 1 wherein the rods are made of fiberglass.

5. The apparatus of claim 1 wherein the flexibility of the rods lies between 0.1 and 0.25 inches per inch of rod length per pound of side deflection force.

6. The apparatus of claim 1 wherein the rod is graduated to indicate the position of the ball on the rod.

7. A method of playing golf on a golf course using a set of flexible throwing rods, each rod of the set having a different flexibility resulting in a different throwing power, each of the rods having a first, and a second ends, a round cross-section, a taper and graduations on the rod near the second end, the first end having a larger diameter than the second end; and a round ball having a diameter equal to the diameter of a standard golf ball, and a diametrical hole therethrough such that the ball may be mounted upon any one of the rods by inserting the rod into the hole, the second end of the rod protruding minimally beyond the ball when the ball is wedged thereon, comprising the steps:

a) selecting an appropriate rod from the set of rods, the rod being selected in accordance with the throwing power derivable therefrom;

b) wedging the ball onto the second end of the rod;

c) swinging the rod in an arc to dislodge the ball from the rod to project the ball into space in a selected direction;

d) repeating steps (a), (b) and (c) in sequence as frequently as required to move the ball incrementally from the tee to the green.

8. The method of claim 7 wherein step (b) further includes the selection of one of the graduations as a positioning point for the ball on the rod thereby controlling the wedge force of the ball on the rod.

* * * * *